United States Patent [19]

Brandstäter et al.

[11] Patent Number: 4,975,088

[45] Date of Patent: Dec. 4, 1990

[54] POTENTIAL CONNECTOR

[75] Inventors: Manfred Brandstäter, Wuppertal; Bernd Zinn, Ennepetal, both of Fed. Rep. of Germany

[73] Assignee: Grote & Hartmann GmbH & Co. KG, Fed. Rep. of Germany

[21] Appl. No.: 372,003

[22] Filed: Jun. 27, 1989

[30] Foreign Application Priority Data

Jun. 30, 1988 [DE] Fed. Rep. of Germany ..... 3822147

[51] Int. Cl.[5] ..... H01R 11/09

[52] U.S. Cl. ..... 439/723; 439/842

[58] Field of Search ..... 439/512, 723, 724, 848, 439/714, 721, 842, 845, 850, 860, 883

[56] References Cited

U.S. PATENT DOCUMENTS

| | | | |
|---|---|---|---|
| 2,816,275 | 12/1957 | Hammell | 439/850 |
| 2,877,442 | 3/1959 | Gettig | 439/723 X |
| 2,903,719 | 9/1959 | Dreher et al. | 439/724 X |
| 3,005,180 | 10/1961 | Dreher | 439/721 X |
| 3,055,970 | 9/1962 | Handley . | |

FOREIGN PATENT DOCUMENTS

| | | |
|---|---|---|
| 0097445 | 1/1984 | European Pat. Off. . |
| 1948297 | 4/1970 | Fed. Rep. of Germany . |
| 3607409 | 6/1987 | Fed. Rep. of Germany . |
| 1574163 | 7/1969 | France . |
| 2291620 | 1/1976 | France . |
| 2312867 | 12/1976 | France . |

*Primary Examiner*—Steven C. Bishop

*Attorney, Agent, or Firm*—Jones, Askew & Lunsford

[57] ABSTRACT

The invention pertains to a potential connector where the insulated ends of several electrical lines are combined in one connector element; where plastic housing (1) with contact plate (2) of electrically conducting metal is provided, having bearing elements (3) for electrical plug connector (4) of e.g., a punched metal article, that is crimped to the insulated ends of the electrical lines.

21 Claims, 2 Drawing Sheets

POTENTIAL CONNECTOR

The invention pertains to an electrical potential connector where the insulated ends of several electrical lines are combined in one connector element.

Such connectors are used e.g., in vehicle electrical systems to run several insulated ends of electric lines to one junction element in the vehicle, based on their equal potentials or due to their ground connections. Known potential connectors consist of a sheet metal housing where the insulated ends of e.g., five to ten electrical lines are squashed together. The production of this potential connector is time-consuming. Machine production is practically impossible and handling of the potential connector is cumbersome.

The problem of the invention is to create a potential connector of simple design allowing machine production and whose handling is simple.

Figure 1:
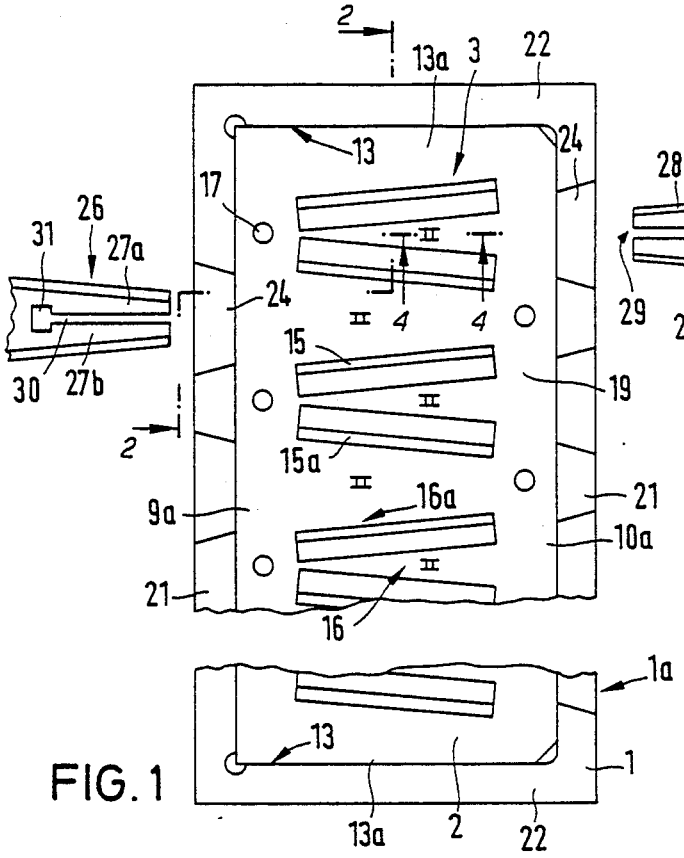

The invention will be explained below with reference to the figures. We have:

FIG. 1: A top view of the potential connector with an open housing.

Figure 2:
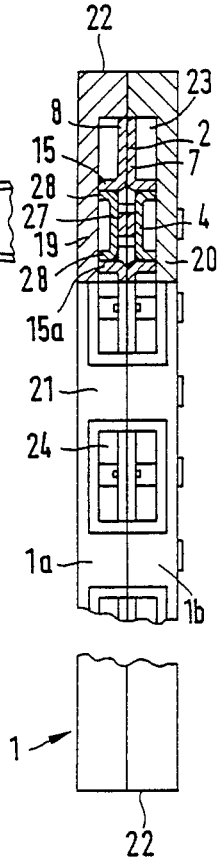
Figure 3:
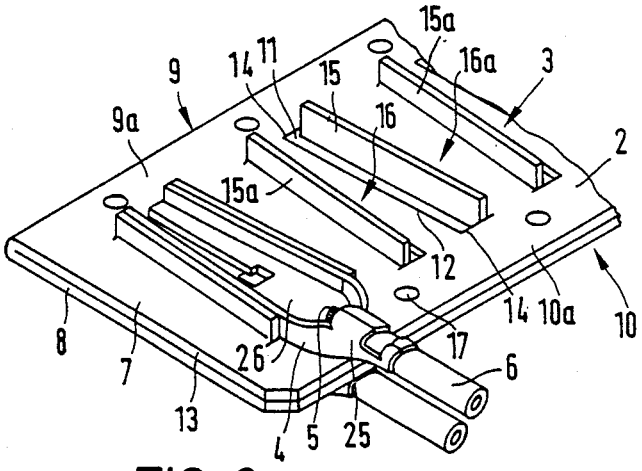
Figure 4:
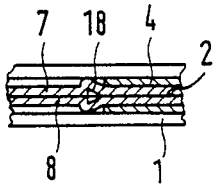
Figure 5:
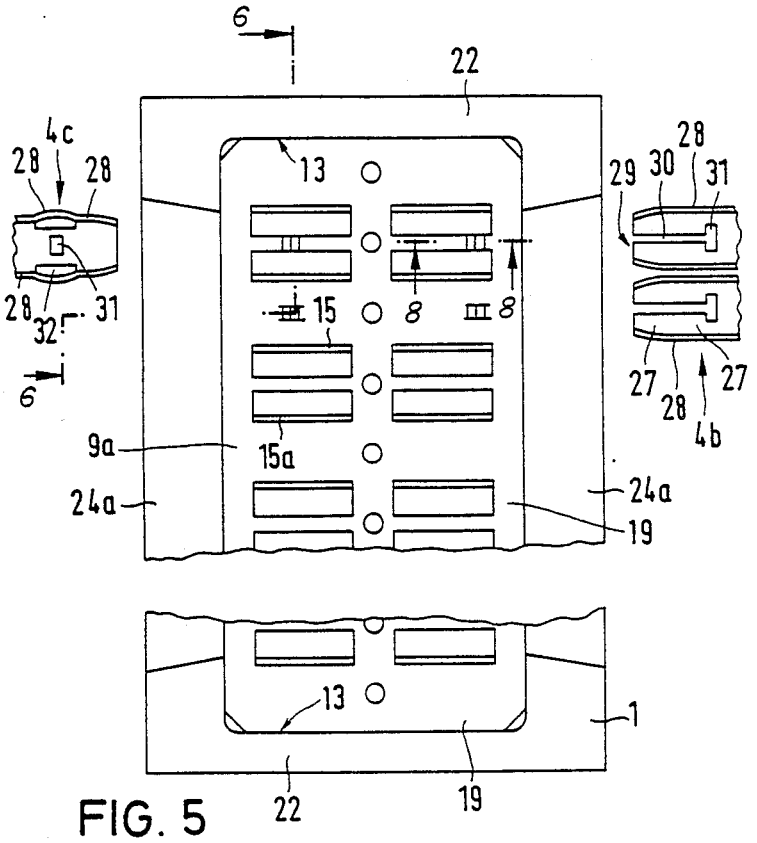
Figure 6:
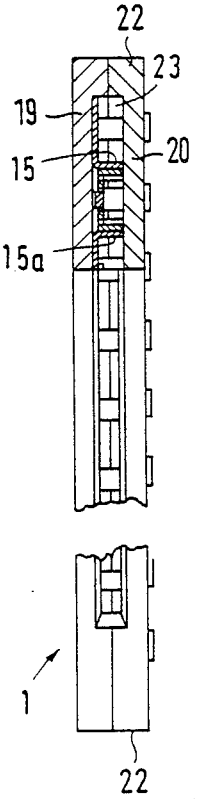
Figure 7:
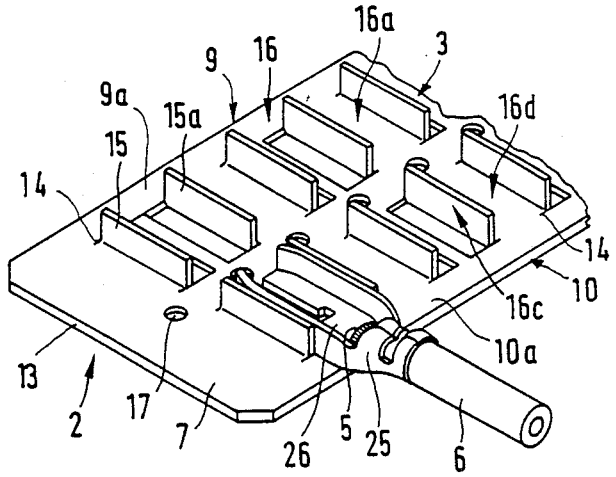
Figure 8:
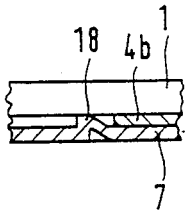

FIG. 2: A side view of the potential connector with partial cross section along line A—A of FIG. 1 viewed in the direction of the arrow, FIG. 3: A perspective view of the contact plate, FIG. 4: A cross section along line B—B of FIG. 1, viewed in the direction of the arrow, FIG. 5: A top view of another design of the potential connector with an open housing, FIG. 6: A side view of the potential connector with partial cross section along line A—A of FIG. 5 viewed in the direction of the arrow, FIG. 7: A perspective representation of the contact plate in the potential connector of FIG. 5, FIG. 8: A cross section along line B—B of FIG. 5, viewed in the direction of the arrow.

The new potential connector consists essentially of preferably quadrilateral plastic housing (1) with metal contact plate (2) in it, bearing elements (3) for electrical plug connectors (4) of punched metal crimped to insulated ends (5) of electric lines (6).

Contact plate (2) consists of a four-cornered sheet of electrical insulating material. The sheet can be of single or double design, as in FIG. 3, i.e., one piece doubled over, to form a top sheet plate (7) and a lower sheet plate (8). At a distance from longitudinal edge (9) to longitudinal edge (10) of contact plate (2), slits (11) are provided that run in the direction of longitudinal edges (9, 10) of cut edge (12) at a distance from cut edges (14) running at a right angle to transverse edges (13) of contact plate (2) and at a distance from each other; this gives a slotted sheet metal fin. The fin is bent off preferably at a right angle to the plane of contact plate (2) and forms abutment bar (15) whose function will be explained below. At a distance to abutment bar (15) there is another abutment bar (15*a*) positioned in the same manner, but as a mirror image of abutment bar (15), where in this example, abutment bars (15 and 15*a*) run conically together and form an upward open plug-in area (16) whose base is formed by contact plate (2) or by the bottom bar left over by slits (11) and its side walls of abutment bars (15) and (15*a*). Abutment bars (15, 15*a*) of neighboring plug-in areas (16) are located so that one plug-in area (16*a*) results between two plug-in areas (16), where abutment bars (15, 15*a*) run toward each other, conically in opposite directions.

Contact plate (2) also has two longitudinal edge areas (9*a*) and (10*a*) and transverse edge areas (13*a*). Holes (17) can be provided in a row at longitudinal edge areas (9*a*, 10*a*) to be used in a known manner as the transport agent for a machine to produce the contact plate, but also for fixed positioning of contact plate (2) in housing (1) and for establishment of two housing halves.

According to one design of the invention (FIG. 4), in the bottom of plug-in areas (16, 16*a*) there are slitted snap tongues (18) or pressed-up snap elevations protruding in the plug-in areas used to snap-lock plug connector (4), as described below.

Sheet metal plate (8) is designed preferably to coincide in size and shape with sheet metal plate (7).

Housing (1) of two stacked, equal housing halves (1*a*, 1*b*) has bottom wall (19), cover wall (20), side walls (21) and front walls (22). In inner chamber (23) of housing (1) there is e.g., clamped contact plate (2). In side walls (21) there are spaced, preferably inwardly pointing conically-tapered plug-in openings (24) which provide access to plug-in areas (16, 16*a*). Holes (17) in contact plate (2) can be filled e.g., by pins shaped in housing halves (1*a*, 1*b*), so that a fixed position of contact plate (2) and a snap-lock or holder for housing halves (1*a*, 1*b*) results (not shown).

Plug connectors (4) cooperating in plug-in areas (16, 16*a*) are distributed along the plug-in areas. They have crimped area (25) that clasps the end of electrical line (6) and contact area (26). Contact area (26) is formed by flat bottomed bar (27) and two, preferably right-angled side wall bars (28) that run together conically to free end (29). The conicity of side wall bars (28) corresponds to the conicity of abutment bars (15, 15*a*), so that plug connector (4) fits form- and/or force-linked into plug-in area (16) or (16*a*).

Preferably slit (30) is provided in bottom bar (27) that extends from free end (29) up to hole (31). Spring arms (27*a*, 27*b*) are formed by slit (30) that can spring elastically to slit (30).

Hole (31) is used expendiently as a counter-snap element for snap-in tongues (18) located in the bottom of plug-in areas (16, 16*a*).

As indicated in FIG. 2, it is preferred that the level of abutment bars (15, 15*a*) be selected so that the bars sit on bottom wall (19) or cover wall (20) of housing (1). Consequently, the level of side wall bars (28) is designed so that bars (28) do not extend beyond bars (15, 15*a*), but preferably align laterally with their upper edges.

The example shown in FIGS. 5–8 has only one contact plate (7). Abutment bars (15, 15*a*) run parallel to each other and are interrupted in the longitudinal middle of contact plate (7), so that two aligned plug-in areas (16, 16*c*) are formed which are allocated to neighboring plug-in areas (16*a*) or (16*d*). Plug-in connectors (4*b*) are adapted to the plug-in areas. Many plug-in connectors (4*b*) can be set onto contact plate (2) on both sides, even though contact plate (2) is only of a simple design.

All other properties of this sample design equal those of the design example of FIGS. 1–4, where only the housing has several side-by-side positioned plug-in openings (24), and at times has one broad plug-in slit (24*a*). The equivalence of the design of the two examples is illustrated by the same reference numbers.

The spatial shape of plug-in connectors (4, 4*b*) is designed so that one plug-in connector is assured for plug-in areas (16, 16*a*) or (16*c*, 16). This plug-in connector is ensured e.g., by plug-in connector (4*c*) whose side wall bars (28) are bulged outward, where preferably, cut-out (32) is provided in the attachment area of bulged areas (28*a*) to bottom bar (27).

Preferably the upper edge of side wall bars (28) is designed tooth-like and extends somewhat beyond the abutment bars, so that the teeth can grasp into the plastic material of walls (19) and/or (20) and can clamp plug-in connector (4*a*, 4*b*) or (4*c*).

What is claimed is:

1. Potential connector where the insulated ends of several electrical lines are combined in one connector element, the connector having a plastic housing (1) in which a contact plate (2) of electrically conducting metal is provided, said contact plate having several bearing elements (3) lying side by side in a row, with abutment bars (15, 15*a*) arranged at intervals from one another and circumscribing the plug-in areas (16) for electrical plug-in connectors (4) made out of metal pieces which are crimped to the insulated ends (5) of electrical lines (6), whereby the housing (1) has a common plug-in slot (24*a*) or plug-in openings (24) for the plug-in areas (16), characterized in that:

the abutment bars (15, 15*a*) are formed by cut-in and angled portions of sheet metal pieces; and the abutment bars (15, 15*a*) of neighboring plug-in areas (16) are arranged such that between each of two plug-in areas (16) a further plug-in area (16*a*, 16*d*) is defined.

2. Potential connector as in claim 1, characterized by the fact that contact plate (2) comprises a four-cornered sheet metal piece.

3. Potential connector as in claim 1, characterized by the fact that the abutment bars (15, 15*a*) are positioned angled conically toward each other.

4. Potential connector as in claim 2, where the abutment bars (15, 15*a*) are positioned in opposing directions, angled conically toward each other.

5. Potential connector as in claim 4, characterized by holes (17) in contact plate (2) provided in a row.

6. Potential connector as in claim 2, characterized by snap-in tongues (18) protruding into plug-in areas (16, 16*a*).

7. Potential connector as in claim 1, characterized by the fact that the contact plate (2) comprises one four-cornered sheet, forming a one-piece joined unit with upper sheet metal plate (7) and lower sheet metal plate (8); and the bearing elements (3) of sheet metal plate (8) are spatially equal and substantially coinciding with those of sheet metal plate (7).

8. Potential connector as in claim 1, characterized by the fact that the abutment bars (15, 15*a*) are positioned running parallel to each other and are interrupted in the longitudinal middle of contact plate (2), so that two aligned plug-in areas (16, 16*c*) are formed which neighbor plug-in areas (16*a*or 16*d*).

9. Potential connector as in claim 8, characterized by the fact that the housing (1) comprises two stacked, equal housing halves (1*a*, 1*b*) with bottom wall (19), cover wall (20), side walls (21) and front walls (22), the contact plate (2) is securely clamped in an inner area (23), and plug-in openings (24, 24*a*) are installed in the side walls (21) allowing access to the plug-in areas (16, 16*a* or 16*c* and 16*d*).

10. Potential connector as in claim 9, characterized by the fact that plug-in connectors (4, 4*b*) are placed on the same area onto plug-in ares (16, 16*a*, 16*c*, 16*d*).

11. Potential connector as in claim 10, characterized by the fact that a contact area (26) of plug-in connector (4) is formed by a flat bottomed bar (27) and two substantially right-angled side walls bars (28) running conically to each other at a free end (29).

12. Potential connector as in claim 11, characterized by the fact that slit (30) is provided in bottom bar (27), said slit extends from free end (29) up to hole (31), and opposing spring arms (27*a*, 27*b*) are formed which are braked elastically to slit (30).

13. Potential connector as in claim 12, characterized by the fact that the hole (31) forms a snap-lock with snap-in tongues (18) of the plug-in areas acting as the opposing snap-element.

14. Potential connector as in claim 9, characterized by the fact that the level of abutment bars (15, 15*a*) is selected so that the bars sit on either the bottom wall (19) or the cover wall (20) of housing (1).

15. Potential connector as in claim 14, characterized by the fact that the level of the side wall bars (28) is selected so that the bars (28) do not extend above the bars (15, 15*a*), aligning with their upper edges.

16. Potential connector as in claim 15, characterized by the fact that the abutment bars (15, 15*a*) run parallel to each other.

17. Potential connector as in claim 16, characterized by the fact that the abutment bars (15, 15*a*) are interrupted in the longitudinal middle of contact plate (2), so that two aligned plug-in areas (16, 16*c*) are formed which are allocated to neighboring plug-in areas (16*a* or 16*d*).

18. Potential connector as in claim 1, further comprising a plug-in connector (4*c*) having side wall bars (28) that are bulged outward.

19. Potential connector as in claim 18, characterized by the fact that a cut-out (32) is provided in the connection region of bulged areas (28*a*) toward a bottomed bar (27).

20. Potential connector as in claim 11, characterized by the fact that the upper edge of the side wall bars (28) are of a tooth-like design.

21. Potential connector as in claim 1, wherein:

the contact plate is one of two such contact plates mounted back to back with each other and having the plug-in areas on both opposite sides of the contact plates.

* * * * *

UNITED STATES PATENT AND TRADEMARK OFFICE

CERTIFICATE OF CORRECTION

PATENT NO. : 4,975,088

DATED : December 4, 1990

INVENTOR(S) : MANFRED BRANDSTATER ET AL.

It is certified that error appears in the above-identified patent and that said Letters Patent is hereby corrected as shown below:

Column 4, line 9, change "ares" to --areas--.

Signed and Sealed this

Twenty-first Day of April, 1992

*Attest:*

HARRY F. MANBECK, JR.

*Attesting Officer*

*Commissioner of Patents and Trademarks*